US006695664B2

(12) United States Patent
Eden et al.

(10) Patent No.: US 6,695,664 B2
(45) Date of Patent: Feb. 24, 2004

(54) MICRODISCHARGE DEVICES AND ARRAYS

(75) Inventors: J. Gary Eden, Mahomet, IL (US); Sung-Jin Park, Yong-In (KR); Clark J. Wagner, Urbana, IL (US)

(73) Assignee: Board of Trustees of the University of Illinois, Urbana, IL (US)

( * ) Notice: Subject to any disclaimer, the term of this patent is extended or adjusted under 35 U.S.C. 154(b) by 0 days.

(21) Appl. No.: 10/040,300

(22) Filed: Oct. 26, 2001

(65) Prior Publication Data

US 2003/0080688 A1 May 1, 2003

(51) Int. Cl.[7] ..... H01J 9/00; H01J 61/06
(52) U.S. Cl. ..... 445/24; 313/631
(58) Field of Search ..... 313/483, 484, 313/485, 486, 492, 493, 461; 445/24, 25, 26, 29, 46

(56) References Cited

U.S. PATENT DOCUMENTS

| | | | | |
|---|---|---|---|---|
| 5,686,789 A | | 11/1997 | Schoenbach et al. | 313/491 |
| 5,939,829 A | * | 8/1999 | Schoenbach et al. | 313/632 |
| 6,016,027 A | | 1/2000 | DeTemple et al. | 313/356 |
| 6,082,294 A | * | 7/2000 | Simpson | 118/723 E |
| 6,139,384 A | * | 10/2000 | DeTemple et al. | 445/24 |

FOREIGN PATENT DOCUMENTS

JP 7192701 7/1995

OTHER PUBLICATIONS

"High–Pressure Hollow Cathode Discharges;" Karl H. Schoenbach et al.; Physical Electronics Research Institute, Old Dominion University, Norfolk, VA, USA; Jun. 30, 1997.

"Microdischarge Devices Fabricated in Silicon;" J.W. Frame et al.; Department of Electrical and Computer Engineering, Everett Laboratory, University of Illinois, Urbana, Illinois, USA; Jun. 30, 1997; App. Phys. Lett. 71 (9), Sep. 1, 1997.

"Flexible Microdischarge Arrays: Metal/Polymer Devices;" S. –J. Park et al.; Laboratory for Optical Physics and Engineering, Department of Electrical and Computer Engineering, University of Illinois, Urbana, Illinois, USA; May 17, 2000; Applied Physics Letters, vol. 77, No. 2, Jul. 10, 2000.

"Emission of Excimer Radiation from Direct Current, High–Pressure Hollow Cathode Discharges;" Ahmed El–Habachi and Karl H. Schoenbach; Electrical and Computer Engineering Department, Physical Research Institute, Old Dominion University, Norfolk, Virginia, USA; Nov. 4, 1997; App. Phys. Lett. 72(1), Jan. 5, 1998.

* cited by examiner

*Primary Examiner*—James Clinger
*Assistant Examiner*—Minh D A
(74) *Attorney, Agent, or Firm*—Brinks Hofer Gilson & Lione

(57) ABSTRACT

A discharge device is described that contains an anode, a cathode, and an insulating layer disposed between the anode and the cathode. A cavity is extends entirely through at least one of the anode or cathode and penetrates the dielectric layer. At least one of the anode or cathode may include a screen or the dielectric layer may have a plurality of films with at least two different dielectric constants. The voltage differences between the anode and cathode in each of multiple devices electrically connected together may be limited.

56 Claims, 4 Drawing Sheets

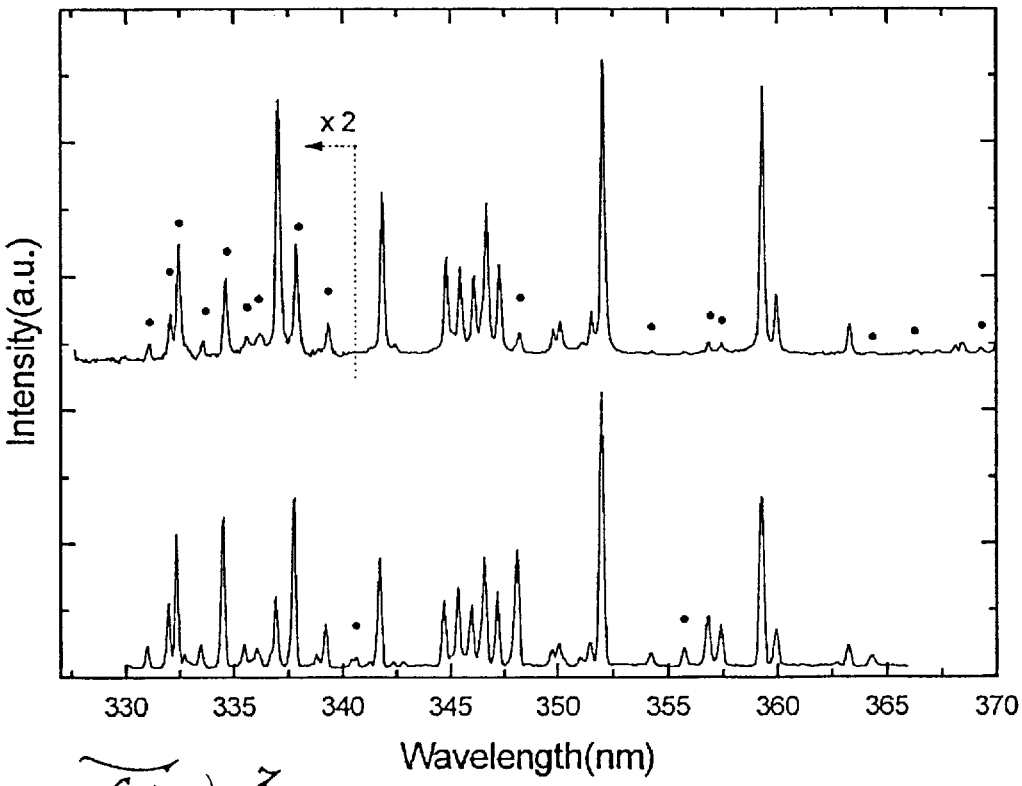
Fig. 3
Fig. 4
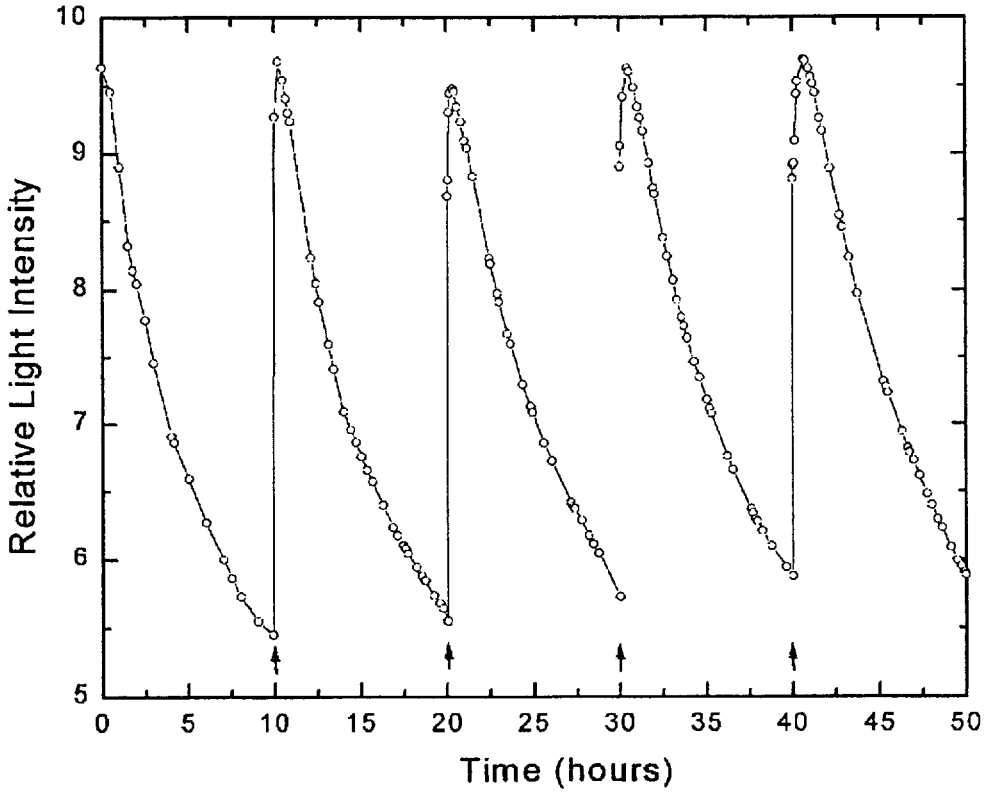

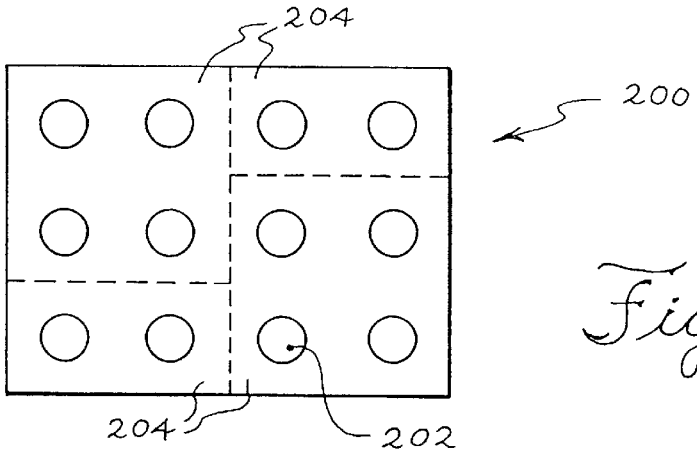
Fig. 5
Fig. 7
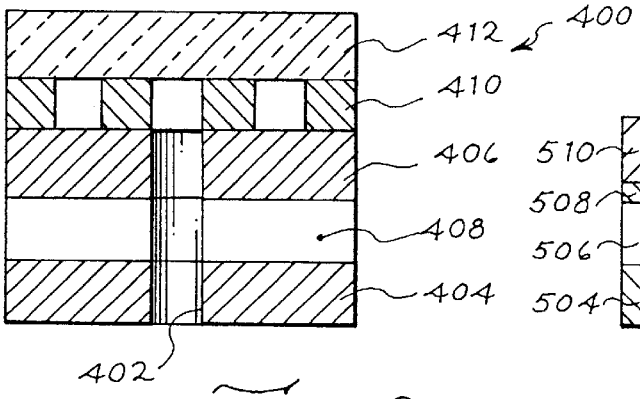
Fig. 8
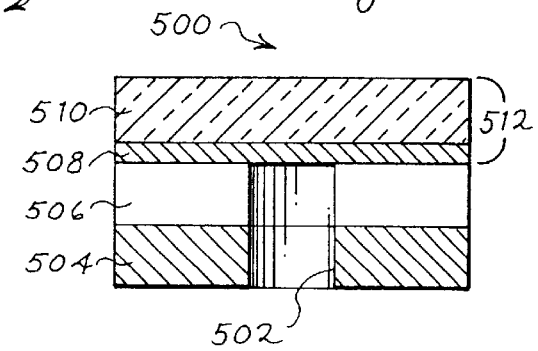
Fig. 9A
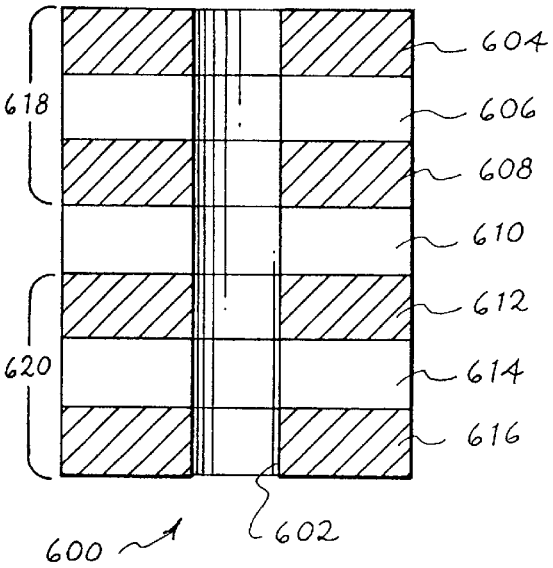
Fig. 9B
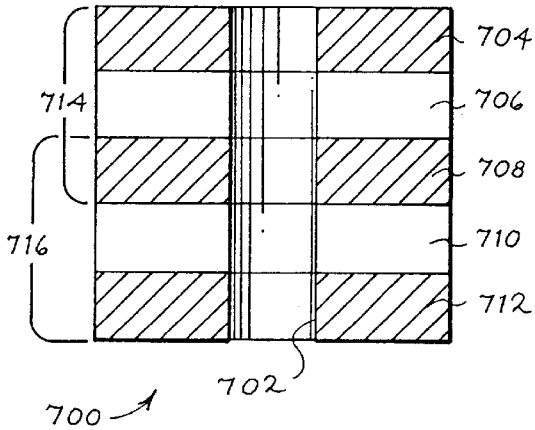

MICRODISCHARGE DEVICES AND ARRAYS

FEDERALLY SPONSORED RESEARCH OR DEVELOPMENT

This invention was made with Government support under Contract Number F49620-98-1-0030 awarded by the U.S. Air Force Office of Scientific Research (AFOSR). The Government has certain rights in the invention

BACKGROUND

The present invention relates to microdischarge devices and, in particular, new structures for light emitting devices and low-cost methods of producing ultraviolet or visible light from thin sheets.

It has long been known that electrical discharges are efficient sources of light and, today, gas discharge lamps (including fluorescent sources, and metal-halide, sodium, or mercury arc lamps) account for most of the world's light-generating capacity (several billion watts on a continuous basis). Most of these devices are, unfortunately, bulky and frequently have fragile quartz or glass envelopes and require expensive mounting fixtures. In addition to general lighting, discharges produce ultraviolet and visible light for other purposes such as germicidal applications (disinfecting surfaces and tissue), cleaning electronic and optical surfaces in manufacturing, and activating light-sensitive molecules for medical treatments and diagnostics.

Although microdischarges were demonstrated by A. D. White in 1959, only recently were microdischarge devices fabricated in silicon by techniques developed in the integrated-circuit industry. As described in U.S. Pat. No. 6,016,027, the first microdischarge devices made in silicon had a cylindrical microcavity that served as the cathode of the device. The semiconductor cathode was affixed to a copper heat sink with conductive epoxy. The anode for the microdischarge device was typically a metal film such as Ni/Cr. A thin dielectric layer deposited onto the silicon electrically insulates the cathode from the anode. When the microcavity is filled with the desired gas and the appropriate voltage imposed between the anode and cathode, a discharge is ignited in the microcavity.

Microdischarges have several distinct advantages over conventional discharges. Since the diameter of single cylindrical microdischarge devices, for example, is typically less than 400–500 $\mu$m, each device offers the spatial resolution that is desirable for a pixel in a display. Also, the small physical dimensions of microdischarges allows them to operate at pressures much higher than those accessible to conventional, macroscopic discharges. When the diameter of a cylindrical microdischarge device is, for example, on the order of 200–300 $\mu$m or less, the device will operate at pressures as high as atmospheric pressure and beyond. In contrast, standard fluorescent lamps, for example, operate at pressures typically less than 1% of atmospheric pressure.

Despite their applications in several areas, including optoelectronics and sensors, silicon microdischarge devices have several drawbacks. For example, the annular metal anodes used in early microdischarge devices have short lifetimes because of sputtering. After operating for as little as several hours, damage to the anode is visible and devices frequently fail after only tens of hours of operation. Optical emission from metal atoms evaporated from the anode is easily detected prior to failure of the device. One solution is to replace the metals tested to date with a more robust material, such as polycrystalline silicon or tungsten. However, these materials increase the fabrication cost and difficulty, do not yield significantly increased output power and may not yield significantly improved device lifetime.

Furthermore, silicon is brittle, comparatively high in cost, and single wafers are limited in size (12" in diameter currently). In addition, silicon fabrication techniques, although well-established, are labor and time intensive and, therefore, not suitable for low-cost applications. Therefore, a number of potential applications of microdischarge devices, not presently accessible with silicon (or other) semiconductor technology, could be pursued if low-cost, flexible microdischarge arrays, requiring voltages no higher than that available in common wall sockets, were available.

Two other drawbacks of previous microdischarge devices and arrays concern the inefficiency of extracting optical power from deep cylindrical cavities and the difficulty in scaling the size of arrays. If the cylindrical cathode for a microdischarge is too deep, it will be difficult for photons produced below the surface of the cathode to escape. Another problem arises in fabricating arrays of microdischarge devices is that devices at the perimeter of the array ignite preferentially and arrays as small as 10×10 are difficult to ignite at all.

BRIEF SUMMARY

In view of the above, novel microdischarge devices and fabrication methods are provided.

In one embodiment, the discharge device comprises a first electrode, a second electrode on the first electrode, a dielectric layer between the first and second electrodes, and a cavity that extends through the first electrode and the dielectric layer. The cavity may contain a gas.

The first electrode may comprise a screen or the dielectric layer may comprise a plurality of films, at least one of the films having a dielectric constant different from at least another of the films.

The first and second electrodes may comprise an optically transmissive material. An optically transmissive sealing material may seal the cavity and an optically transmissive protective material may be disposed between the sealing material and the cavity.

In another embodiment, an array of the discharge devices may comprise a plurality of discharge devices electrically connected together. When a minimum voltage sufficient to cause discharge of at least 10 of the devices is applied, then a voltage difference between the first and second electrode at every cavity of the at least 10 devices has a voltage difference of no more than 20% of an average voltage difference between the first and second electrodes of the at least 10 devices.

The following figures and detailed description of the embodiments will more clearly demonstrate these and other advantages of the present invention.

BRIEF DESCRIPTION OF THE DRAWINGS

FIG. 3 compares the ultraviolet emission spectrum for an embodiment of the present invention with that of a silicon microdischarge device;

FIG. 4 shows data obtained for an embodiment of the present invention obtained over a period of 50 hours;

FIG. 5 is a top view of an embodiment of the present invention;

FIG. 7 is a sectional illustration of an embodiment of the present invention;

FIG. 8 is a sectional illustration of an embodiment of the present invention;

FIG. 9A is a sectional illustration of an embodiment of the present invention; and FIG. 9B is a sectional illustration of an embodiment of the present invention.

DETAILED DESCRIPTION

The present invention provides microdischarge devices and arrays of microdischarge devices that are inexpensive to manufacture and have electrical and optical characteristics that are superior to previous microdischarge devices. These microdischarge devices and arrays may operate at atmospheric pressure and at voltages of 120V or less, and preferably at voltages of not greater than 100 V. Either direct current (DC) or alternating current (AC) voltages may be applied to the electrodes. The microdischarge devices and arrays of microdischarge devices may also be flexible.

Figure 1:
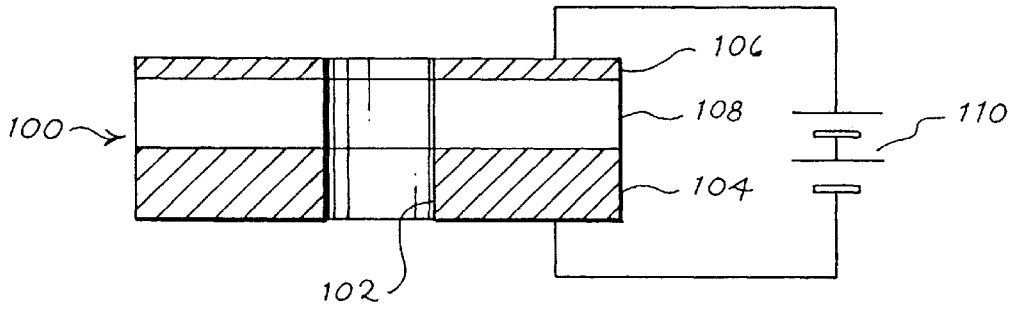
FIG. 1 is a sectional illustration of an embodiment of the present invention.

An embodiment of a microdischarge device (not drawn to scale) is shown in FIG. 1. The microdischarge device 100 includes a first electrode 106, a second electrode 104 and a dielectric layer 108 (also called an insulating layer or an insulator) disposed between the first electrode 106 and second electrode 104. A cavity 102 is formed in the insulator 108 and may be additionally formed in either or both of the first electrode 106 and the second electrode 104 such that the openings or holes in each of the first electrode 106, insulator 108, and second electrode 104 are aligned with each other. The cavity 102 preferably has a substantially cylindrical shape to more easily couple to optical fiber, for example, and is formed in a direction transverse to the planes containing the electrodes 104 and 106 and insulator 108. The first electrode 106 and second electrode 104 are both electrically and thermally conductive and a potential difference across the insulator 108 is established by a voltage source 110 connected between the first electrode 106 and the second electrode 104. The potential difference creates a discharge in the cavity 102 when a gas is present. The resulting light has emission spectra that are characteristic of the gas selected. This light is subsequently emitted from at least one end of the cavity 102.

The first electrode 106 and second electrode 104 preferably serve to establish the potential difference across the insulator 108 and thereby energize the microdischarge device 100. Thus, the first electrode 106 and second electrode 104 are fabricated from materials having good electrical and thermal conductivity. The first electrode 106 and second electrode 104 may be planar and may be fabricated from thin layers of conductive material, preferably having a thickness of less than 100 $\mu$m, more preferably thicknesses from about 10 Å-10 $\mu$m and from 50 Å-5 $\mu$m. Common metals that may be used to form the electrodes include copper, aluminum, gold, silver, nickel, and zinc and alloys thereof. Other conductors include polymers containing carbon black and other conducting polymer materials or highly doped crystalline, polycrystalline or amorphous semiconductor films. Alternatively, rather than the electrodes being formed from an optically opaque material, at least one of the electrodes may be fabricated from a solid layer of optically transmissive material that does not significantly absorb light at the wavelength of the discharge, such as indium tin oxide (ITO). Optically transmissive material transmits preferably at least 50% of the light impinging substantially normal to the surface of the material at wavelength emitted by the discharge. More preferably, the optically transmissive material transmits at least 60%, 70%, 80%, 90%, or even 95% of the light impinging substantially normal to the surface of the material at a wavelength emitted by the discharge. The first electrode 106 and second conducting electrode 13 preferably form a cathode and an anode.

At least one of the electrodes is preferably deposited, plated, or otherwise disposed onto the dielectric layer to establish a film of conducting material around the rim of the cavity in the dielectric layer. Furthermore, although not shown, at least one of the electrodes may be fabricated from multiple layers, at least one of which (preferably the layer closest to the discharge) is electrically conducting. The other layers may serve as a mirror to reflect light of undesired wavelengths back into the microdischarge.

The first electrode 106 may additionally act as a support for the microdischarge device 100. One example of such a structure would be using Kapton onto which a thin conducting film is deposited or a foil is in contact.

The second electrode 104 is preferably thinner than the first electrode 106. The insulator 108 is formed of a material having a resistivity of at least 0.1 Ω-cm, preferably from 0.5 Ω-cm-100 Ω-cm or from 1.0 Ω-cm-10.0 Ω-cm.

The insulator 108 acts as a dielectric layer to electrically isolate the first electrode 106 and second electrode 104 of the microdischarge device 100. Preferably, the insulator 108 has excellent thermostability and high dielectric strength, e.g. $T_g$>200° C. and at least $10^4$ V-cm, respectively. More preferable ranges for the thermostability include 400° C.>$T_g$>250° C. and 350° C.>$T_g$>275° C. and for the dielectric strength from $5\times10^4$ V-cm–$5\times10^6$ V-cm or $10^5$ V-cm–$5\times10^5$ V-cm.

The insulator 108 may be a polymer such as polyimide, which has exceptional thermostability and dielectric strength. For example, the breakdown voltage for a polyimide film about 5 $\mu$m thick is approximately 1.2 kV, giving a dielectric strength in excess of $10^6$ V-cm. Other dielectrics, resins and polymers—for example, oxide and nitride films such as metal oxides, $SiO_2$, $Si_3N_4$ or KAPTON—may be used as long as the material retains its insulation properties at the material thickness required for adequate dielectric strength. Furthermore, multiple films of different materials (having different dielectric constants) may be used to fabricate the insulator in order to improve both individual device and array performance. Tests have shown that a multiple layer dielectric (containing, for example, ~0.5 $\mu$m $Si_3N_4$, 0.5 $\mu$m $SiO_2$, and several microns of polyimide) not only improves the voltage-current characteristics of an individual microdischarge device but also makes it possible to realize stable operation of large arrays (for example, 30×30) of devices. If, on the other hand, the insulator 108 is a single film of polyimide, for example, it is difficult to operate arrays larger than approximately 5×5.

The insulator 108, in addition to the first electrode 106 and second electrode 104, may also be thin, preferably less than 100 $\mu$m. Preferred thickness ranges for the insulator 108 may be from 10 Å-100 $\mu$m or 100 Å-10 $\mu$m. The voltage applied between the first electrode 106 and second electrode 12 to create the discharge is directly related to the thickness of the dielectric layer 108; as well as the particular gas and gas pressure in the cavity. Scaling the thickness of the insulator 108 thus changes the magnitude of the operating voltage of the microdischarge device 100. Some applications may additionally require fabrication of the first electrode 106, insulator 108, and second electrode 104 using materials that have appropriate conductive/dielectric properties at the desired device thicknesses.

The cavity 102 formed in the insulator 108 may extend through either (or both) the first electrode 106 or the second electrode 104. The cavity 102 is preferably cylindrical and has a diameter of 0.1 $\mu$m–1 mm. More preferably, the diameter ranges from 0.1 $\mu$m–500 $\mu$m, 1 $\mu$m–100 $\mu$m, or 100 $\mu$m–500 $\mu$m. The cavity 102 will be filled with a gas selected for its breakdown voltage or light emission properties at breakdown. Light is produced when the voltage difference between the first electrode 106 and the second electrode 104 creates an electric field sufficiently large to electrically break down the gas (nominally about $10^4$ V-cm). This light escapes from the microcavity 102 through at least one end of the cavity 102.

The gas that fills the cavity 102 may be selected for its light emission properties. The term gas herein refers to acceptable single gases, gas mixtures, and vapors. Examples of common gases that work well alone are the rare gases (He, Ne, Ar, Xe, and Kr), $N_2$, and air. A wide variety of gas mixtures also produce intense emission from atomic or molecular species. An example of the former is Ar/Hg vapor and the latter includes rare gas/halogen donor gas mixtures (such as one or more rare gases mixed with $F_2$, $NF_3$, $XeF_2$, $N_2F_4$, HCl, $Cl_2$, $I_2$, HI or other halogen-bearing molecules). Another example is the XeO (xenon oxide) excimer that is produced in mixtures of Xe and $O_2$, $N_2O$ or $NO_2$ gases. Such gases, however, need not be present in the channel: breakdown may occur when air is present.

The microdischarge device 100 may be less than 50 $\mu$m thick (approximately two one-thousandths of an inch), thus giving rise to a thinner device than is typical of conventional microdischarge devices. One feature of arrays of such devices is that the finished array may be flexible and light. Thus, these arrays are able to conform to various shapes and can, if desired, be rolled into a tube. This feature enhances the portability and utility of microdischarge arrays.

The possible radius of curvature of the microdischarge device 100 (or array of devices) may be much smaller than that of conventional brittle silicon-based microdischarge devices. For comparison, the radius of curvature of a silicon wafer is several meters while that of an adult human arm is approximately five cm. The realizable radius of curvature of the microdischarge device 100, is preferably from several meters to less than a single mm. For flexible microdischarge devices, the realizable radius of curvature may be substantially less, preferably between 1 cm and 1 m or 10 cm and 100 cm. Thus, a feasible radius of curvature of an array of microdischarge devices may be that of human limbs or smaller. In a group of these flexible discharge devices (either a planar array or stack), when first bent by less than the maximum possible radius of curvature, a substantial percentage of the discharge devices should continue to operate. Preferably, the device failure rate should not significantly change when bending the array as long as the operating conditions remain the same. This is not to say that problems such as fractures will not appear in the devices, but only that the operating characteristics (e.g. voltage, current, emission intensity) should not decrease beyond acceptable levels. For the purposes of the specification and claims herein, the radius of curvature is defined as the minimum radius of curvature to which the device is able to be bent before the device failure rate rises beyond acceptable levels, preferably above 50%. Alternatively, the radius of curvature may be defined as the minimum radius of curvature to which the device is able to be bent before a specific percentage of the devices in an array fail. Preferably fewer than 50% of the devices fail to insure adequate operation when used during therapeutic treatment, for example; more preferably fewer than 20%, 10%, 5%, 2%, or even 1% fail.

One method of fabrication of the microdischarge device 100 is to mechanically assemble the various layers that comprise the microdischarge device 100. Thus, assembly begins with individually positioning the first electrode 106, insulator 108 and second electrode 104 on each other and then forming the cavity 102 in the assembled layers by any of several processes such as mechanical or ultrasonic drilling, optical drilling (preferably by a pulsed laser), dry etching or wet chemically etching. These techniques are all well developed in the semiconductor industry. In an alternate method of fabrication, holes may be formed in the insulator 108 and either (or both) of the first electrode 106 and second electrode 104. After forming the hole(s), the first electrode 106, insulator 108 and second electrode 104 may be assembled such that the insulator 108 is sandwiched by the first electrode 106 and second electrode 104. Preferably, the layers are positioned such that the holes in the layers coincide to form the cavity 102.

In another method of fabrication, the first electrode 106 may be positioned and the insulator 108 formed on the first electrode 106. The insulator 108 may be fabricated by spin coating or otherwise depositing a film on the first electrode 106. The second electrode 104 is subsequently deposited on the insulator 108. The cavity 102 is then preferably formed through the insulator 108 and at least one of two electrodes 11 and 13.

Alternatively, the first electrode 106 may preferably be deposited onto an insulating substrate (not shown), which provides a supporting surface for first electrode 106. The insulator 108 and second electrode 104 may next be fabricated as above, i.e. spin coating and subsequent deposition, and then the cavity 102 formed. In this case, the first electrode 106 may either be temporarily attached to the insulating substrate and the insulating substrate removed after assembling the layers or the first electrode 106 may be permanently attached to the insulating substrate. In either case, the cavity 102 may be formed through the insulating substrate (if present), the first electrode 106, and the insulator 108 after the layers are assembled. Similarly, the cavity 102 may be formed through the second electrode 104 and the insulator 108 after the layers are assembled, whether or not the insulating substrate is present.

In an embodiment in which the insulating substrate permanently covers the cavity 102, the insulating substrate may preferably comprise an optically transmissive material. However, for embodiments in which the insulating substrate is temporarily attached to the first electrode 106 or in which the cavity 102 is formed through the insulating substrate, the insulating substrate may comprise any suitable insulating material. An example of such an insulating substrate may be poly(pyromellitimido-1,1',4,4'-diphenylene ether), also known as PMDA-ODA poly(pyromellitimido-oxydianiline) or KAPTON.

Other methods for forming the first electrode 106 on the insulating substrate include evaporation, growth, sputtering, deposition, or attaching with conductive paste. Similar methods may be used for forming the insulator 108 on the first electrode 106 and for forming the second electrode 104 on the insulator 108. Examples of methods for forming the cavity 102 include mechanical drilling, optical drilling preferably by a pulsed laser, and chemically etching the different layers.

After the second electrode 104, insulator 108 and first electrode 106 have been assembled and the cavity 102 formed, the cavity 102 may then be filled with a specified amount or pressure of a selected gas. Light produced by a discharge in the gas is emitted from the opening of the cavity 102. Additionally, the cavity 102 may be sealed while containing the desired gas at the proper pressure by laminating or bonding a plastic sheet, glass, quartz or mica (not shown) on to both sides of the microdischarge array assembly, thereby sealing the microdischarge device 100 while still allowing the generated light to pass through the sealing material. Thus, an optically transmissive material may be used to seal the cavity 102 of the microdischarge device 100. Preferably, the sealing material may be flexible in addition to being optically transmissive.

Sealing of the microdischarge cavity while containing the desired gas at the proper pressure may be performed in a number of ways other. One method is to "hard seal" the array of microdischarge electrodes and insulator to a quartz window having a conducting film (such as ITO) or a fine metal grid on one side. The bonding process takes place with the conductor facing the electrode and bonding occurs along the entire perimeter of the electrode and quartz. When completed, this structure is robust and compact, requiring only electrical connections to an appropriate power supply. Another approach using flexible optically transmissive material is to laminate an array of electrode/insulator/electrode (or screen) devices. By laminating a plastic sheet on both sides of the microdischarge array assembly, light generated within the array will be transmitted by the packaging if the laminating sheet material is chosen properly. A phosphor/electroluminescent material may also be included on the screen before sealing.

To operate the microdischarge device 100, a voltage is applied between the first electrode 106 and second electrode 104, which produce a discharge in the gas in the cavity 102. The resulting light produces emission spectra that are characteristic of the gas or gas mixture selected. This light is subsequently emitted from at least one end of the cavity 102.

EXAMPLES

Figure 2:
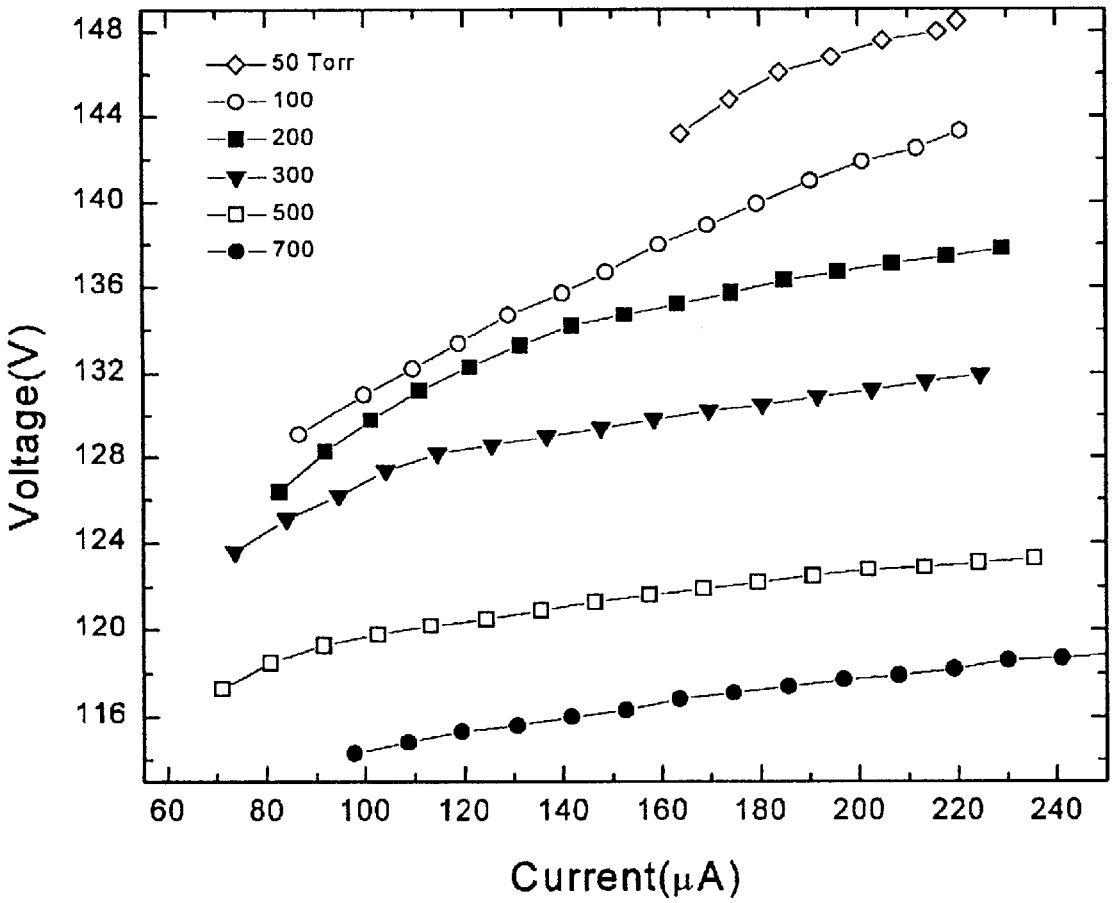
FIG. 2 shows V-I characteristics of an embodiment of the present invention.

One example of such a microdischarge device 100 has a 25 $\mu$m thick copper foil as the first electrode 106, a polyimide film 5–8 $\mu$m thick as the insulator 108, and a 2000 Å thick Ni film as a second electrode 104. FIG. 2 shows the voltage-current (V-I) characteristics for this Ni/polyimide/Cu microdischarge device. The polymer film for the insulator 108 was formed by spin coating a solution of 20 wt % of poly (trimetallic anhydride chloride-alt benzidine) in a 1-methyl-2-pyrolidinone/xylene solution on the copper foil. Residual solvent was evaporated by a hot plate and a vacuum drying process at >200° C. The Ni second electrode 104 was next evaporated onto the polymer, giving a total device thickness of about 30 $\mu$m. Microdischarge cavities 14 having a diameter of typically 150 $\mu$m were then produced either by mechanically drilling or using a pulsed Ti:$Al_2O_3$ laser to bore through the second electrode 104, insulator 108 and first electrode 106. Once fabricated, the microdischarge device 100 was evacuated to about $10^{-6}$ Torr by a turbomolecular pump. The polymer was subsequently vacuum baked to minimize possible outgassing by the polymer and then backfilled with the desired gas, Ne. By observing the emission spectrum of a rare gas produced by the microdischarge device 100, freedom from (or the presence of) hydrocarbon impurities was determined.

The positive differential resistance of tested microdischarge devices was 30 kΩ-120 kΩ depending on the gas pressure in the cavity 102 (100 Torr to 700 Torr, respectively). These differential resistances are comparable to conventional planar silicon microdischarge devices, as shown in FIG. 2. However, unlike the conventional planar silicon microdischarge devices, which typically work at gas pressures considerably less than one atmosphere and require at least 200 V to operate, the microdischarge device 100 operates both at gas pressures approaching one atmosphere and voltages at or below 120 V. Furthermore, although the data of FIG. 2 were obtained for a polyimide thickness of about 5 $\mu$m, the operating voltages vary with the thickness of the polyimide layer in a roughly proportional manner. For example, tested microdischarge devices with polyimide layer thicknesses of about 7 $\mu$m and 10 $\mu$m exhibit operating voltages of about 180 V and 250 V, respectively, and, thus, thinner polyimide films (i.e., <5 $\mu$m) should yield operating voltages well below 100 V.

The device of FIGS. 1 and 2 operates in a manner similar to that of conventional metal/$SiO_2$/silicon devices. FIG. 3 illustrates a comparison of a portion of the ultraviolet emission spectrum (320–370 nm) produced from neon gas for the above Ni/polyimide/Cu foil device with that of a conventional Ni/$SiO_2$ (20 $\mu$m thick)/silicon microdischarge device. The conventional microdischarge device had an overall thickness of 57 $\mu$m and a cavity diameter of 180 $\mu$m, both somewhat greater than the thickness (30 $\mu$m) and diameter (150 $\mu$m) of the Ni/polyimide/Cu microdischarge device. The solid dots denote emission lines produced by the singly-charged neon ion (i.e. $Ne^+$). Note that the two spectra are virtually identical, showing strong emission from more than 20 Ne ion transitions. The emission intensity of several of the $Ne^+$ ion transitions in the Ni/polyimide/Cu device is weaker than the same transitions in the conventional microdischarge device, owing to the smaller depth of the cathode. Nevertheless, the strength of the ion emission lines from the metal/polymer device show that the electron energy distribution has a component that is "hotter" (higher energy) than that for a conventional positive column discharge.

The microdischarge devices are also remarkably robust. The emission intensity as a function of time was measured for a large number of microdischarge devices. FIG. 4 shows lifetime data obtained for a single Ni/polyimide/Cu microdischarge device obtained over a period of 50 hours. This device had a 150 $\mu$m diameter cavity and was filled with Ne at a pressure of 300 Torr. The V-I characteristics of the microdischarge device remained stable over the entire 50 hours. Every ten hours, the Ne gas was refreshed due to a decline in intensity caused by the outgassing of the polymer and a small "background" leak in the vacuum system. As shown in FIG. 4, after each refill of Ne gas, the emission intensity of the microdischarge device returned to approximately the initial value, indicating that no device degradation had occurred. Neither the outgassing nor the background leak is a limitation of the device itself and obtaining lifetimes that exceed several thousand hours is expected to be quite feasible.

For example, a 3×3 array of Ni/polyimide/Cu microdischarge devices operating in 400 Torr of Ne at 4.5 mA and 165 V demonstrated intense emissions that could readily be seen across a well-lit room. However, if one wishes to fabricate large arrays or a collection of microdischarge devices, ohmic losses become a problem. Large arrays often do not ignite uniformly; rather, devices at the perimeter of the array ignite preferentially because of the non-uniformity in the applied voltage difference across different cavities in the array. Large arrays contain at least 10 individual devices, preferably at least 20 individual devices, and more preferably at least 50 or 100 individual devices.

To overcome this problem, another embodiment, shown in FIG. 5, divides the overall array 200 into sub-arrays 204 containing individual devices 202 and delivers power separately to the sub-arrays 204. The sub-arrays 204 may be independently excited or otherwise excited such that the devices 202 no longer ignite preferentially. For example, the sub-arrays 204 may have at most one of the two electrodes in common or may be excited in parallel. Alternatively, the entire array 200 may have multiple conductive leads from the voltage source and provided to selected areas of the array 200 or may have continuous strips of the conductive leads crossing the array 200 in a grid-like manner. Further, each device may be individually excited and ballasted. These arrangements are only examples of techniques that may be used to provide the desired uniformity to the array 200.

Such designs minimize ohmic losses in the electrodes as arrays increase in size and improve the characteristics and reproducibility for igniting the array or collection. In addition, these designs decrease the voltage variation appearing across individual devices in at least 10 of the devices in the array. This decrease is such that when a minimum voltage sufficient to cause discharging of the at least 10 of the devices is applied then the voltage difference between the first and second electrodes at every cavity of the discharge devices has a voltage difference of no more than 20% of the average voltage difference. The lower the voltage difference between a desired set of devices in the array, the better the uniformity in emission. Thus, more preferably the voltage difference may be no more than 10%, 5%, 2%, or 1% of the average voltage difference of at least 10, 20, 50, 100, 1000 or 10,000 devices.

In addition to exciting the sub-arrays independently, using a multiple film dielectric allows one to realize much larger arrays that are well behaved, for the reasons above. The addition of a screen on top of one electrode or replacing one of the electrodes with a screen still further improves device and array characteristics, as discussed below.

Some of the embodiments may be manufactured as single microdischarge devices or arrays of devices by mass production techniques. The materials used in the microdischarge device of these embodiments are thin and inexpensive relative to conventional microdischarge devices. Similarly, the material characteristics of microdischarge devices of the embodiments are thus manufacturable by large-scale processes, unlike arrays of Si-based microdischarge devices, which are limited in size, typically to 12" Si wafers. One example of such a process is a "roll-to-roll" manufacturing process in which individual rolls of the three layers of one embodiment (two laminating layers and the microdischarge layer, including anode, cathode, and dielectric) are assembled into one roll. This assembly would, of course, take place in the presence of the desired gas or gas mixture so that the finished laminated devices would have the proper gas in each microcavity discharge. Also, immediately prior to laminating the devices, the microcavities could be formed by any of several processes, as mentioned before, including laser micromachining. After large sheets of microdischarge devices are fabricated at low cost, these sheets may subsequently be cut into smaller sections and then fitted with electrical connections to be applied to any number of uses.

As described above, a single microdischarge device or arrays of devices having an insulating substrate may also be produced by the same manufacturing processes. More specifically, in large-scale roll-to-roll manufacturing, rolls of metal film forming the first and second electrodes may be assembled on Kapton (as the insulating substrate) and another polymer as the insulator. The cavities may then be machined by imaging laser radiation onto the metal/polymer/metal sandwich through a mask. Such imaging techniques are well-known in the laser micromachining industry. The cavities may also be formed by alternate methods, such as mechanically drilling or punching holes.

To mass-produce the microdischarge devices also may require an inexpensive means of sealing the microdischarge device. As discussed above, the microdischarge device may be sealed by lamination with an optically transmissive material to enclose the cavity containing the gas. The process may include sealing the microdischarge device or array of microdischarge devices between two sheets of optically transmissive material in the presence of the desired gas (in much the same way a driver's license is laminated).

A conventional plastic laminate may be used to seal the device. One problem with this is that the plastic may outgas impurities into the gas and limit the lifetime of the laminated microdischarge device. However, the lifetime the sealing material is not a fundamental limitation on the device lifetime. For example, the lifetime of the microdischarge device will increase when using sealing materials that outgas less. Similarly, depositing a thin transmissive film, such as tantalum oxide or glass, onto conventional laminating sheets will impede or eliminate the outgassing process and extend the lifetime of the microdischarge devices. Another alternative may be a vacuum baking procedure to significantly reduce the outgassing of the conventional laminate sheets.

Figure 6A:
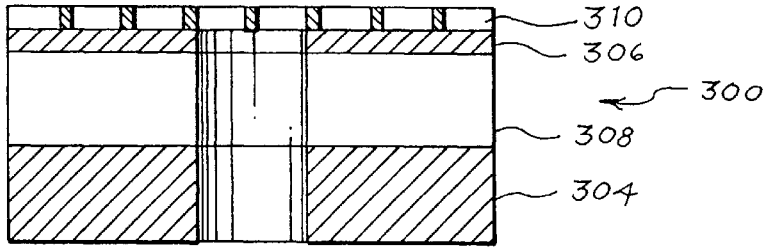
FIG. 6A is a sectional view of an embodiment of the present invention.

In another embodiment, illustrated in FIG. 6A, the device 300 includes a conducting screen electrode (or screen) 310 that is in contact with and extends across at least one of the first electrode 304 or the second electrode 306 of the microdischarge device 20. The screen 310 improves both the lifetime and light output of the microdischarge device 300, making it more efficient by allowing the device 300 to operate at lower voltages and producing greater light output power at the same power. The result of this is that the emission intensity of discharge from the end of the cavity 302 in which the screen 310 is present is up to, for example, an order of magnitude larger than the emission intensity when a screen 310 is not present.

Figure 6B:
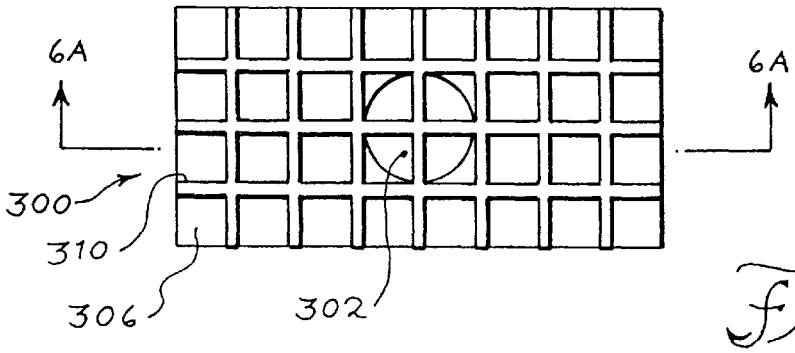
FIG. 6B is a top view of an embodiment of the present invention.

The screen 310, as shown in FIG. 6B, preferably has openings that are no larger than the diameter of the cavity 302 of the microdischarge device 300. Preferably, screens 310 are constructed of a metal such as Ni, Au, or Cu, which are available commercially as sample holders for Transmission Electron Microscopy (TEM) and are chosen such that most of the light reaching the screen 310 from the microdischarge passes through the screen 310. The thickness of the screen 310 may range from 10 Å-10 mm, and preferably ranges from 1 $\mu$m–500 $\mu$m including 10 Å-10 $\mu$m, 10 Å-1 $\mu$m, and 100 Å-1 $\mu$m. Other conductive materials may also be used to form the screen 310, such as ITO, which does not absorb substantially at a wavelength emitted by the discharge. The screen 310 may be mounted onto either (or both) the first electrode 304 or second electrode 306. The screen 310 presents a more uniform electrostatic potential to the discharge in the cavity 302 as the screen 310 covers at least part of the hole in the electrodes 304 and 306.

Figure 6C:
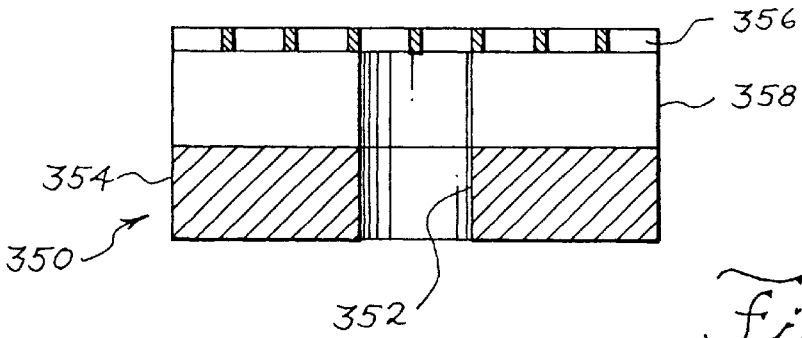
FIG. 6C is a sectional view of an embodiment of the present invention.

Alternatively, FIG. 6C shows an embodiment of a device 350 in which the conducting screen 356 replaces the second electrode, rather than being disposed on the second electrode. Although FIG. 6C depicts an embodiment in which the screen 356 replaces the second electrode, as above, the screen 356 may replace the first electrode 354 or screens may replace both electrodes. An insulator 358 is disposed between the screen 356 and the other electrode 354, with the cavity 352 present as above. One feature of a microdischarge device 300 having a screen 310 is that the emission intensity of light from the end of the cavity 302 in which the screen 310 is present is up to an order of magnitude larger than the emission intensity emerging from the other end of the cavity 302 in which the screen 310 is not present. In one example, a Ni/polyimide/Cu microdischarge array having a Ni screen with 55 $\mu$m×55 $\mu$m square openings and in contact with the second electrode exhibited intense emission and was clearly observed across a well-lit room.

In addition to light being emitted from the cavity, electrons may also be extracted from the cavity of the microdischarge device via the screen electrode, thereby forming a plasma cathode. This may be used in another embodiment, illustrated in FIG. 7, in which a microdischarge device 400 includes a phosphor or electroluminescent material 412 disposed onto the screen 410. Although not shown, the phosphor or electroluminescent material 412 may also be disposed onto a non-conducting window adjacent to the screen 410 on the opposing side of the screen 410 as the second electrode 406. In addition, the phosphor or electroluminescent material 412 may be disposed on both sides of the device 400.

Thus, in this embodiment, electrons are generated in the cavity 402 by the voltage potential between the second electrode 406 and the first electrode 404. The majority of the electrons are then extracted from the cavity 402 through the screen 410 and then impinge upon the phosphor or electroluminescent material 412, which luminesces. As in the embodiment shown in FIG. 6C, the screen 410 may replace one of the electrodes 404 and 406, preferably at least the electrode disposed under the phosphor or electroluminescent material 412. Furthermore, one variation on this embodiment would be to insert a non-conducting layer between the screen 410 and the proximate electrode. This would allow one to operate the microdischarge continuously but illuminate the phosphor 412 only when a voltage pulse is applied between the insulator 408 and the screen 410 that would attract the electrons towards the screen 410.

An alternative embodiment, in which the second electrode and screen electrode are replaced by a conducting (but optically transmissive) electrode 512, is shown in the microdischarge device 500 in FIG. 8. The conducting electrode 512 is a combination of layers that may include a conducting film 508 disposed on a supporting surface 510. The conducting film 508 is fabricated from at least one material that is both conducting and optically transmissive, such as ITO and is disposed over the entire insulator 506 including the opening to the cavity 502. The conducting film 508 serves as the second electrode but, in addition, establishes a uniform potential surface for the discharge cavity 502, similar to the screen of previous embodiments. The supporting surface 510 may be fabricated from at least one optically transmissive material and may be formed from a conducting material. In addition, the material forming the supporting surface 510 may act as a combination supporting surface, window, and material sealing the cavity 502. Examples of acceptable materials used to form the supporting surface 510 include glass, plastics and resin/polymers. Furthermore, window 510 need not be fully transmissive but, for some applications, translucence will suffice. As above, the first electrode 504 may also be replaced by a similar conducting electrode 512.

A method for fabricating the conducting electrode 512 includes forming the insulator 506 on the first electrode 504 (using one of the methods mentioned above), depositing the conducting film 508 onto the supporting surface 510, and then sealing the structure by combining these layers. The conducting electrode 512, containing the conducting film 508, traverses the entire microdischarge device 500 or array of microdischarge devices and again presents a more uniform potential surface to the discharge cavity 502. An advantage of this embodiment over the embodiment containing a screen electrode is that the light output of the microdischarge device or array of microdischarge devices is not limited by the openness of the screen.

A number of potential applications of microdischarge technology would become accessible if thin, low cost microdischarge arrays were available. Custom lighting and photodynamic therapy are two such examples of industrial and medical applications that would be ideally suited for such a technology. Photodynamic therapy, for example, is a medical treatment of rapidly growing importance that involves destroying harmful cells in the human bloodstream with light. The target cells are "tagged" with a chromophore (light absorbing molecular ligand) that, after attaching to specific cells in the bloodstream, typically absorbs light strongly in the red or near-infrared, for example, by chemically attaching a chromophore to an antibody specific for the cell. This wavelength range is of particular interest because human skin transmits (passes) light in this spectral region. When the light enters the bloodstream and is absorbed by the chromophore, the cell is destroyed. A thin, low cost, flexible and efficient source of red or near-infrared light would be ideally suited for this application. A flexible sheet of microdischarges, emitting in the red, for example, could be wrapped around the arm of a patient with a VELCRO strip in much the same way that blood pressure is measured. For a predetermined period, such as an hour or two, the patient could read or perform other light activity as the phototherapy is carried out. Once treatment is completed, the light source could be discarded because of its low cost. That is, each patient would be treated with a new "arm wrap" source. Such a product will also have numerous applications in manufacturing (polymer curing, stereolithography), and medicine (germicidal applications, phototherapy, cellular diagnostics).

Another use of multiple microdischarge devices is gas chromatography i.e. the determination of the composition of a gas. In this application, a gas flows laterally between a planar array of microdischarge devices and an opposing planar array of detectors. Each detector has an optical axis that coincides with the corresponding microdischarge device and has a filter that transmits a particular wavelength or set of wavelengths (i.e. a bandpass, low-pass or high-pass filter). Only particular wavelengths are transmitted by the gas, while others are absorbed. Thus, each detector detects light of a particular wavelength generated by the microdischarge devices and that passes through the gas present. As the gas to be tested enters each microdischarge, it is energized (excited) and emits light at wavelengths characteristic of the particular gas. Each detector, then, would observe a particular wavelength region, enabling the composition of the gas flow stream (or the presence of impurities in the gas flow stream) to be determined.

One method to determine the composition is to have the planar array emit light of a broad set of wavelengths and vary the filters of the corresponding detectors. Another method to determine the composition is to vary the wavelength of the light emitted from the microdischarge devices in the planar array, perhaps by varying the gas that fills the microdischarge devices, and having the same filter for each corresponding detector. In either case, data are collected and the composition of the gas determined from the transmission/absorption spectra of the gas. The microdischarge devices may emit either incoherent light (such as the custom lighting arrays above) or coherent light (as described by the microlasers described below). Alternately, these methods may be combined—that is, various sets of microdischarge devices in the array could emit light of the same wavelength, with each set emitting light of a different wavelength from another set. In this case, various filters may be used to transmit light to the detectors. Note that in some applications, such as chemical sensors, only a few tens of individual devices may be required, while in other applications, such as industrial lighting, thousands to millions of individual lighting may be required.

The microdischarge device 600 may also be combined to form a stack of individual microdischarge devices 618 and 620, as shown in FIG. 9A. The microdischarge device 600 comprises a first microdischarge device 618, including a first electrode 604, insulator 606, and second electrode 608 similar to the individual devices shown in FIG. 1 and a second microdischarge device 620 comprising another second electrode 616, insulator 614, and first electrode 612. An insulating material 610 is disposed between the first microdischarge device 618 and the second microdischarge device 620. The number of microdischarge devices present in the microdischarge device 600 is arbitrary, depending on the desired characteristics of the overall device. However, the cavity 602 of the microdischarge device 600 is formed by aligning the cavities of the individual microdischarge devices 618 and 620 for greater efficiency or by machining cavity 602 through layers 604–616 once the structure has been assembled.

Alternatively, as shown in FIG. 9B, one second electrode or first electrode for each device and the insulating material between the devices may be removed in forming a microdischarge device 700. In this case, the first electrode 708 for the first microdischarge device 714 may serve as the second electrode for the second microdischarge device 716. Thus, the structure of the microdischarge device 700 may be: second electrode, 704, insulator$_1$ 706, first electrode$_1$/second electrode$_2$ 708, insulator$_2$ 710, first electrode$_2$/second electrode$_3$ 712, etc. . . . , with the cavities 702 aligned. Similarly, any of the microdischarge devices of the preceding embodiments may be stacked. In another embodiment (not shown) the microdischarge devices may be essentially back-to-back, i.e. the second electrode for the first microdischarge device may serve as the second electrode for the next microdischarge device or the first electrode for the first microdischarge device may serve as the first electrode for the next microdischarge device.

The microdischarge devices 600 and 700 may be fabricated in a manner similar to that given above for the individual microdischarge devices in the above embodiments, i.e., fabrication of the microdischarge device 700 may be relatively simple in an embodiment in which the layers are successively stacked: second electrode$_1$ 704, insulator$_1$ 706, first electrode$_1$/second electrode$_2$ 708, insulator$_2$ 710, and first electrode$_2$/second electrode$_3$ 712.

The cavity 702 may be formed either in each layer individually before stacking the layers or after the layers have been stacked. The cavity 702 of the microdischarge devices 600 and 700 may be filled with the selected gas and then sealed. For example, the microdischarge device 700 may be positioned in a vacuum chamber, the chamber evacuated and then backfilled with the selected gas, and the cavity 702 sealed. A microdischarge device having a screen electrode or optically transmissive conducting film may additionally require mechanical assembly of the layers in a vacuum chamber that has been backfilled with the selected gas to permit the gas to fill the cavity of each individual microdischarge device.

One application using the microdischarge device 600 and 700 is a multi-stage structure for the remediation of toxic gases. This application entails flowing a gas that is environmentally hazardous or toxic through a series of microdischarges in the cavity 602 to break down the gas into benign products. Alternatively, the products of the gas discharge can be reacted with a titration gas ($O_2$, $N_2$, etc.) to produce a benign product rather than being completely broken down. In this application, the flow of the hazardous/toxic gas through the cavity 602 is imperative, and thus, the microdischarge device 600 and 700 would not be sealed by a laminate. Similarly, the individual microdischarge devices 618 and 620 would not be sealed by a conducting film disposed between the succeeding dielectric layers (although a screen electrode may still be disposed between the succeeding microdischarge devices 618 and 620).

The microdischarge device 600 shown in FIG. 9A is also ideally suited for realizing a microlaser. Additional components (not shown) that are well known in the art, such as a mirror set, may be used to realize the microlaser. The stack of individual microdischarge devices 618 and 620 are aligned such that the discharge axes are coincident. These microlasers can generate ultraviolet ($N_2$, rare gas halide excimers), visible, or infrared radiation that may be used in materials processing or atmospheric diagnostic applications.

As mentioned before, while one focus of the present invention has been generally toward a flexible microdischarge device, some applications may not require flexibility, e.g., custom lighting, gas chromatography, and lasers. Benefits are conferred in these applications by the use of a thin insulator between the second electrode and first electrode other than silicon. The use of a thin insulator reduces the thickness of the various devices and additionally decreases the material and fabrication costs of the microdischarge device compared with conventional microdischarge devices using silicon (for example, which must be etched to form the cavity). The lack of necessity of flexibility for these applications allows some of the materials used in the microdischarge devices described above to include more rigid, yet inexpensive materials. For example, in some applications the second electrode or first electrode may be constructed of amorphous or polycrystalline silicon instead of metal. Similarly, the insulator sandwiched between the second electrode and first electrode may be an undoped or low doped semiconductor. For example, silicon with a doping of $10^{15}$ $cm^{-3}$ or less may be sufficient to form an insulator. Additionally, material to seal the cavity or the supporting surface for the conducting film that replaces the metal second electrode may be glass rather than a plastic or resin. Although Si is generally used as the preferred material, any semiconductor material, such as group IV (Ge, diamond), III-V (GaAs, InP) and II-VI (ZnSe) materials, may also be used.

While the present invention has been described with reference to specific embodiments, the description is illustrative of the invention and not to be construed as limiting the invention. Various modifications and applications may occur to those skilled in the art without departing from the true spirit and scope of the invention as defined in the appended claims.

We claim:

1. A discharge device in which a discharge is formed, comprising:

a first electrode;

a second electrode on the first electrode;

a dielectric layer between the first and second electrodes; and a cavity in the dielectric layer and extending into the second electrode, wherein the first electrode comprises a screen and electron multiplication in the discharge occurs primarily outside the screen.

2. The discharge device of claim 1, wherein at least one of the first electrode and second electrode comprises an optically transmissive material.

3. The discharge device of claim 1, further comprising one of a phosphor and an electroluminescent material on the screen.

4. The discharge device of claim 1, further comprising optically transmissive sealing material to seal the cavity.

5. The discharge device of claim 4, further comprising an optically transmissive protective material disposed between the sealing material and the cavity.

6. The discharge device of claim 1, further comprising a gas disposed within the cavity.

7. The discharge device of claim 1, wherein the second electrode comprises a plurality of layers, at least one of the plurality of layers being electrically conductive.

8. The discharge device of claim 7, wherein the at least one of the plurality of layers is disposed more proximate to the cavity than remaining layers of the second electrode.

9. The discharge device of claim 8, wherein the remaining layers reflect light of undesired wavelengths back into the cavity.

10. The discharge device of claim 9, wherein the gas has a breakdown voltage of at least $10^4$ V-cm.

11. The discharge device of claim 9, wherein both the first and second electrode are formed from an optically transmissive material and entirely cover openings of the cavity.

12. The discharge device of claim 1, wherein the dielectric layer comprises a plurality of films, at least one of the films having a dielectric constant different from at least another of the films.

13. The discharge device of claim 1, wherein the first electrode further comprises a conductive layer disposed between the dielectric layer and the screen.

14. A plurality of discharge devices according to claim 1, wherein the devices are arranged in an array.

15. The array of discharge devices of claim 14, further comprising an optically transmissive sealing material to seal the cavities.

16. The array of discharge devices of claim 15, further comprising an optically transmissive protective material disposed between the sealing material and the cavities.

17. The array of discharge devices of claim 14, wherein the dielectric layer comprises a plurality of films, at least one of the films having a dielectric constant different from at least another of the films.

18. The array of discharge devices of claim 14, wherein the devices in the array are divided into sub-arrays.

19. A lighting array comprising the plurality of discharge devices according to claim 14.

20. An array for photodynamic therapy comprising the plurality of discharge devices according to claim 14.

21. A gas chromatography array comprising the plurality of discharge devices according to claim 14.

22. A plurality of discharge devices according to claim 1, wherein the devices are arranged in a stack.

23. A microlaser comprising the plurality of discharge devices according to claim 22.

24. A hazardous gas remediator comprising the plurality of discharge devices according to claim 22.

25. The discharge device of claim 1, wherein the cavity extends entirely through both of the first and second electrodes.

26. The discharge device of claim 25, wherein the cavity has the same general shape and dimensions throughout the dielectric layer and first and second electrodes and the screen defines openings in the cavity.

27. The discharge device of claim 1, wherein the dielectric layer comprises one of a polymer, an oxide and a nitride.

28. The discharge device of claim 1, wherein a discharge in the cavity is formed when a voltage of 120 V is applied between the first electrode and the second electrode.

29. The discharge device of claim 1, wherein a thickness of the device is at most 100 $\mu$m.

30. The discharge device of claim 1, further comprising a gas having a pressure of greater than 250 Torr within the cavity.

31. The discharge device of claim 1, wherein the device is flexible and has a radius of curvature of at most several meters.

32. A discharge device, comprising:

a first electrode;

a second electrode on the first electrode;

a dielectric layer between the first and second electrodes; and a cavity that extends through the dielectric layer, wherein the dielectric layer comprises a plurality of films, at least one of the films having a dielectric constant different from at least another of the films.

33. The discharge device of claim 32, further comprising a gas disposed within the cavity.

34. The discharge device of claim 32, wherein the cavity terminates before extending entirely through either of the first and second electrodes.

35. The discharge device of claim 32, wherein the cavity extends entirely through both of the first and second electrodes.

36. The discharge device of claim 35, wherein the cavity has the same general shape and dimensions throughout the dielectric layer and first and second electrodes and the screen defines openings in the cavity.

37. The discharge device of claim 32, wherein at least one of the first and second electrodes comprises an optically transmissive material.

38. The discharge device of claim 37, wherein the optically transmissive material entirely covers an opening of the cavity.

39. The discharge device of claim 32, further comprising optically transmissive sealing material to seal the cavity.

40. The discharge device of claim 39, further comprising an optically transmissive protective material disposed between the sealing material and the cavity.

41. The discharge device of claim 32, wherein at least one of the first and second electrodes comprises a plurality of layers, at least one of the plurality of layers being electrically conductive.

42. The discharge device of claim 41, wherein the at least one of the plurality of layers is disposed more proximate to the cavity than remaining layers of the second electrode.

43. The discharge device of claim 42, wherein the remaining layers reflect light of undesired wavelengths back into the cavity.

44. The discharge device of claim 32, wherein at least one of the first and second electrodes comprises a screen and a conductive layer disposed between the dielectric layer and the screen.

45. A plurality of discharge devices according to claim 32, wherein the devices are arranged in an array.

46. The array of discharge devices of claim 45, further comprising an optically transmissive sealing material to seal the cavities.

47. The array of discharge devices of claim 45, further comprising an optically transmissive protective material disposed between the sealing material and the cavities.

48. The array of discharge devices of claim 45, wherein the devices in the array are divided into sub-arrays.

49. A lighting array comprising the plurality of discharge devices according to claim 45.

50. An array for photodynamic therapy comprising the plurality of discharge devices according to claim 45.

51. A gas chromatography array comprising the plurality of discharge devices according to claim 45.

52. A plurality of discharge devices according to claim 32, wherein the devices are arranged in a stack.

53. A microlaser comprising the plurality of discharge devices according to claim 52.

54. A hazardous gas remediator comprising the plurality of discharge devices according to claim 52.

55. The discharge device of claim 32, wherein the device is flexible and has a radius of curvature of at most several meters.

56. The discharge device of claim 32, wherein a discharge is formed in the device and electron multiplication in the discharge occurs primarily outside of the first and second electrodes.

* * * * *